US011807033B2

(12) United States Patent
Sganga

(10) Patent No.: US 11,807,033 B2
(45) **Date of Patent: *Nov. 7, 2023**

(54) TOOL HAVING INTEGRAL SAFETY HANGER

(71) Applicant: Peter Sganga, Larchmont, NY (US)

(72) Inventor: Peter Sganga, Larchmont, NY (US)

( * ) Notice: Subject to any disclaimer, the term of this patent is extended or adjusted under 35 U.S.C. 154(b) by 655 days.

This patent is subject to a terminal disclaimer.

(21) Appl. No.: 17/015,572

(22) Filed: Sep. 9, 2020

(65) Prior Publication Data

US 2021/0023876 A1 Jan. 28, 2021

Related U.S. Application Data

(63) Continuation-in-part of application No. 16/692,462, filed on Nov. 22, 2019, now Pat. No. 10,806,245.

(60) Provisional application No. 62/877,948, filed on Jul. 24, 2019.

(51) Int. Cl.

| | |
|---|---|
| ***B44D 3/12*** | (2006.01) |
| ***A46B 15/00*** | (2006.01) |
| ***A46B 17/08*** | (2006.01) |
| ***A46B 17/02*** | (2006.01) |

(52) U.S. Cl.

CPC ..... *B44D 3/123* (2013.01); *A46B 15/0095* (2013.01); *A46B 17/02* (2013.01); *A46B 17/08* (2013.01); *A46B 2200/202* (2013.01)

(58) Field of Classification Search

CPC ..... A46B 17/02; A46B 2200/202; A46B 15/0095; A46B 15/0097; B44D 3/123; F16B 45/00

USPC ..... 15/143.1

See application file for complete search history.

(56) References Cited

U.S. PATENT DOCUMENTS

| | | | |
|---|---|---|---|
| 1,130,759 | A | 3/1915 | Osborn |
| 2,309,990 | A | 2/1943 | Savi |
| 3,231,919 | A | 2/1966 | MacDonald |
| 3,432,875 | A | 3/1969 | Edelson et al. |
| 4,821,361 | A | 4/1989 | Meimeteas |
| 4,887,327 | A | 12/1989 | Meimeteas |
| 5,087,014 | A | 2/1992 | Desjardin |
| 5,406,668 | A | 4/1995 | Goodhue |
| 5,636,904 | A | 6/1997 | Bell et al. |
| 6,244,559 | B1 | 6/2001 | Stanton |
| 7,658,352 | B2 | 2/2010 | Gronbach |
| 9,351,561 | B2 | 5/2016 | McCarthy |
| 10,021,966 | B2 | 7/2018 | Ortiz et al. |
| 10,051,952 | B2 | 8/2018 | Aide |

(Continued)

*Primary Examiner* — Laura C Guidotti
*Assistant Examiner* — Aaron R McConnell
(74) *Attorney, Agent, or Firm* — NOTARO, MICHALOS & ZACCARIA P.C.; John S. Economou

(57) ABSTRACT

A tool is disclosed having an integral safety hanger. The tool has a handle including a gripping portion and a neck portion, and a channel within the handle which passes completely through the handle. A hanger assembly is provided which is mounted at a first end thereof within the channel and which includes one or more arm elements adapted to move between a position completely within the channel to positions on either a first side of the handle outside of the channel and/or a second side of the handle outside of the channel, the one or more arm elements are adapted to securely hold the tool on a lip of a container when the one or more arm elements are moved to the first position and/or to the second position.

13 Claims, 16 Drawing Sheets

(56) References Cited

U.S. PATENT DOCUMENTS

| | | | | |
|---|---|---|---|---|
| 10,806,245 | B1 * | 10/2020 | Sganga | A46B 17/02 |
| 2020/0305591 | A1 * | 10/2020 | Byrne | A46B 17/04 |

* cited by examiner

TOOL HAVING INTEGRAL SAFETY HANGER

FIELD

This disclosure relates generally to a tool having an integral safety hanger and more specifically it relates to a tool such as a paint brush having an integral hanger for safely hanging the tool from a paint can or other object.

BACKGROUND

Paint brushes and other tools have been in use for a very long time, and, during use, may need to be put down somewhere during use. This may occur, for example, when a painter is ascending or descending a ladder or when changing between paint brushes. Although solutions exist for securing a paint brush temporarily to its own paint can, such solutions are based on hangers which are only on one side of the brush handle and are not easily moved between the open and closed position. Such solutions are thus inefficient and awkward to open and close, e.g., when a left-handed painter uses a sash brush with angled bristles, the hanger may either be in the way or simply on the wrong side of the brush handle. Such a painter may be forced to change the hand holding the paint brush in order to expose the hanger, which can be difficult if the painter is on a ladder.

Accordingly, there is a need for improved tool having an integral hanger that overcomes such problems.

BRIEF DESCRIPTION OF THE DRAWINGS

The following detailed description, given by way of example and not intended to limit the present disclosure solely thereto, will best be understood in conjunction with the accompanying drawings in which.

DETAILED DESCRIPTION

In the present disclosure, like reference numbers refer to like elements throughout the drawings, which illustrate various exemplary embodiments of the present disclosure.

The present disclosure describes a number of embodiments of a brush having an integral hanger for hanging on a paint container. The principles of the present disclosure are equally applicable to other tools, including spackle and putty knives, taping knives, trowels, cleaning brushes, surgical and dental instruments, etc.

Figure 1:
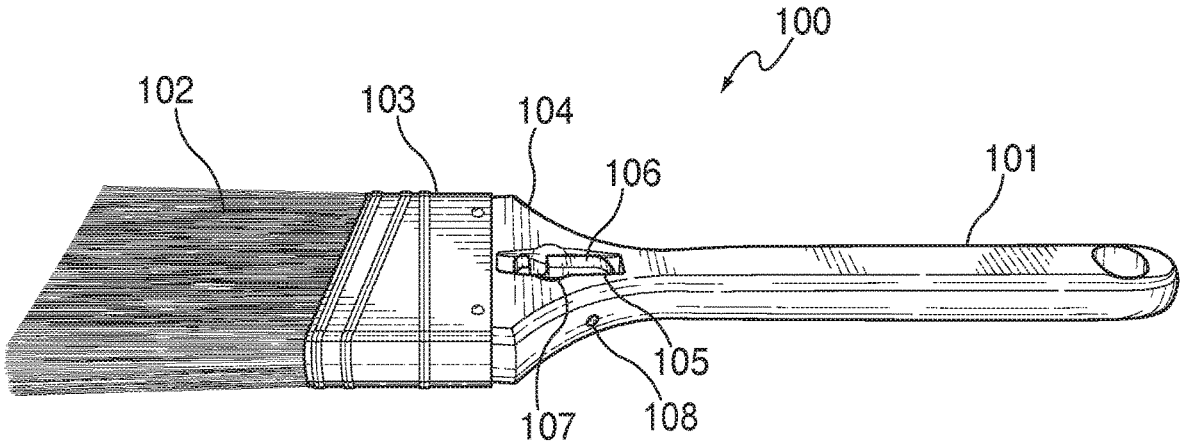
FIG. 1 is a diagram showing a first embodiment of a brush having an integral hanger in a closed position according to the present disclosure.

Referring to FIGS. 1, 2A, 2B, and 4, in a first embodiment, a paint brush 100 conventionally includes a handle having a gripping portion 101 and a neck portion 104, a ferrule 103, and bristles 102. Ferrule 103 conventionally holds bristles 102 in place and is mated to the neck portion 104. Paint brush 100 also includes a channel 105 formed vertically (parallel to the position of the bristles 102) in the neck portion 104 that passes completely through neck portion 104. A hanger 106 is hingedly mounted in channel 105, preferably via a pin 108. In an alternative embodiment, hanger 106 or an inner wall of channel 105 may include bump portions, instead of an aperture, with corresponding concave receptacles within the inner wall of channel 105 or on hanger 106, respectively, allowing a press-fit configuration that enables a user to easily remove hanger 106 for cleaning any dried paint out of channel 105. As can be seen from FIGS. 1 and 2, hanger 106 may rotate between a closed position (FIG. 1) and an open position (FIG. 2). Because channel 105 passes completely through neck portion 104, hanger 106 can rotate to an open position on either side of paint brush 100. This allows either right-handed or left-handed painters to be able to open hanger 106 with one hand, which is especially useful and safer when the paint brush is a sash brush having angled bristles (as shown in FIG. 1), in which case the painter will typically handle such a paint brush in one particular position (meaning a left-handed painter will hold a sash paint brush on the opposite side as will a right-handed painter).

Paint brush 100 also includes a beveled portion 107 which can be placed anywhere along the edge of channel 105 and which is used to easily open hanger 106. When hanger 106 is open, a painter can easily rest the paint brush 100 on a lip of a paint container 110, as shown in FIG. 3, without having to transfer paint brush 100 from one hand to the other (as could be required if a hanger only opened on one side of a paint brush). In FIGS. 1 to 4, paint brush 100 preferably has a wooden handle 101, 104 and hanger 106 and pin 107 are formed from wood as well. In all of the embodiments disclosed herein, the component parts of the brush may be formed from any appropriate material, including wood, plastic, metal, composites, etc., including combinations thereof. In an alternative embodiment, a portion of ferrule 103 may be cut away and channel 105 may be moved towards bristles 102 or channel 105 may be moved away from ferrule 103 towards gripping portion 101. In some cases, channel 105 may be positioned within gripping portion 101 when it is desired to suspend the brush 100 during rest periods with bristles 102 within the paint in the container. This position ensures that paint on the bristles 102 will not dry out so that brush 100 will be ready for use upon completion of a rest period.

Figure 2A:
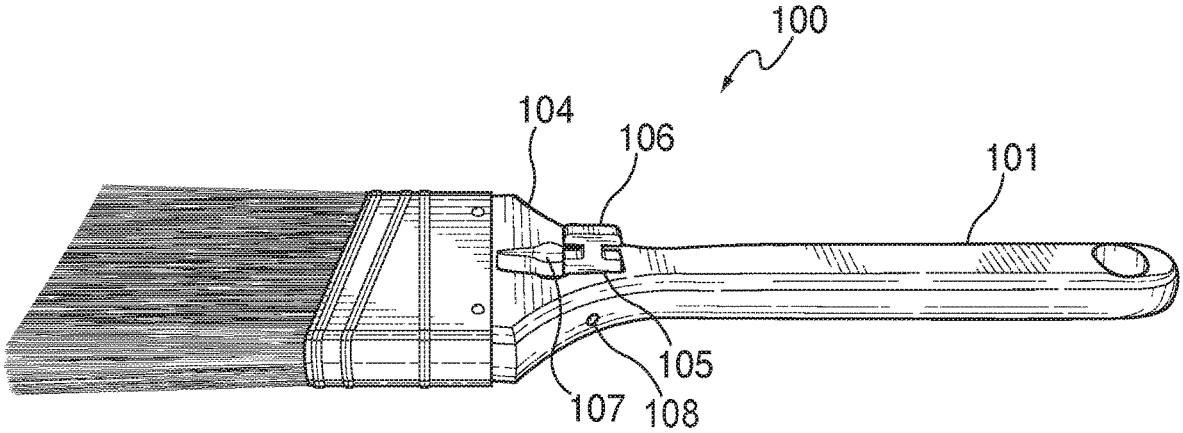
FIG. 2A is a diagram showing the first embodiment of the brush having an integral hanger in an open position according to the present disclosure.
Figure 2B:
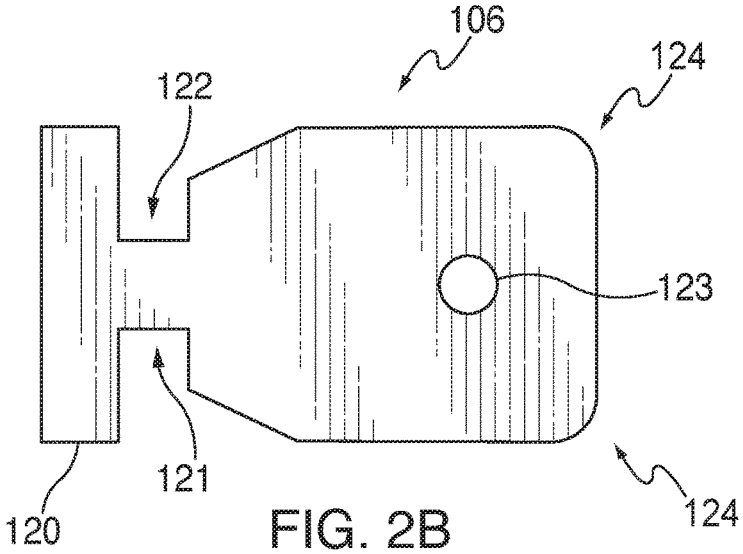
FIG. 2B is a diagram of the integral hanger of the first embodiment.
Figure 3:
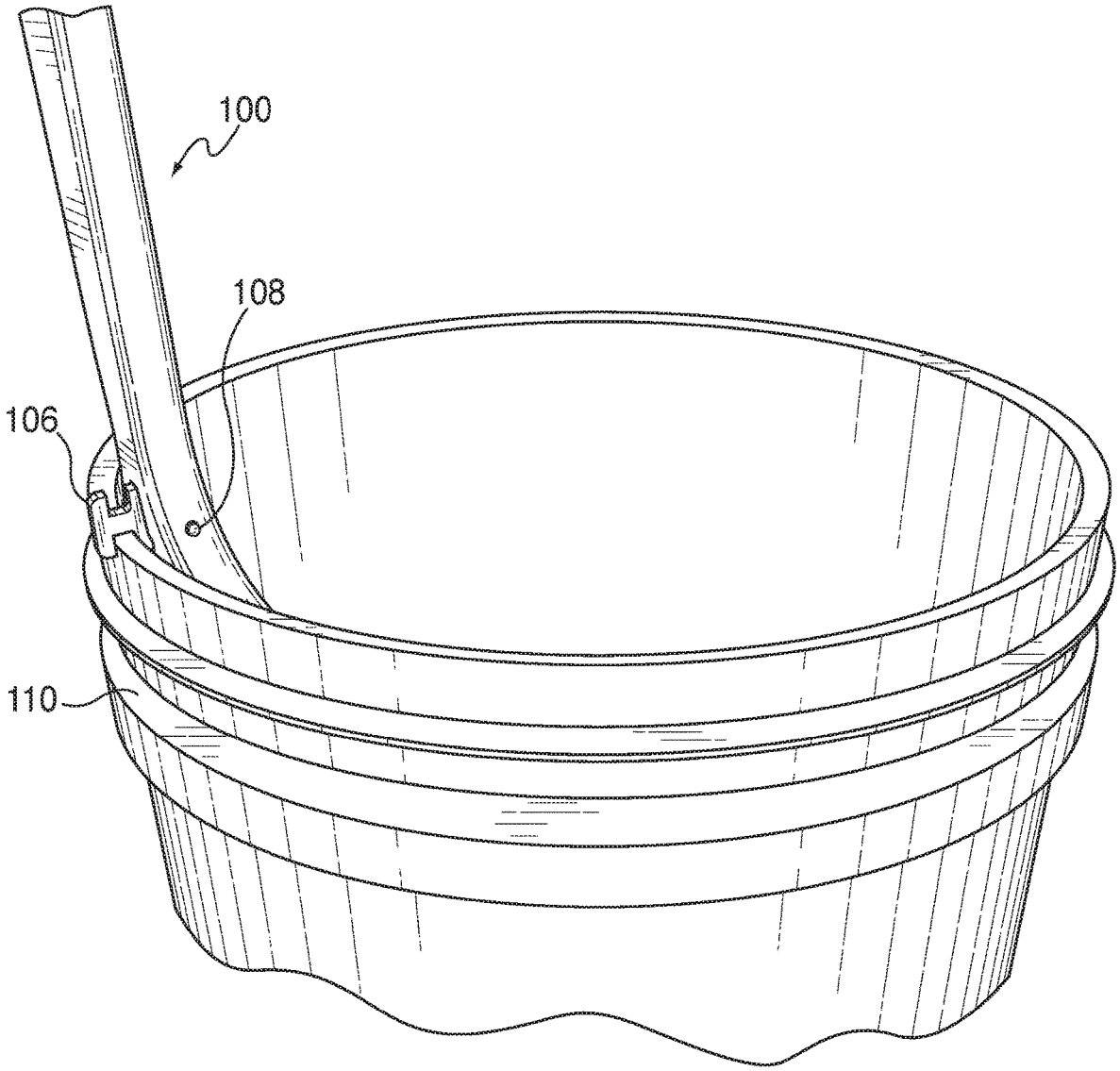
FIG. 3 is a diagram showing the first embodiment of the brush hanging in a paint container according to the present disclosure.
Figure 4:
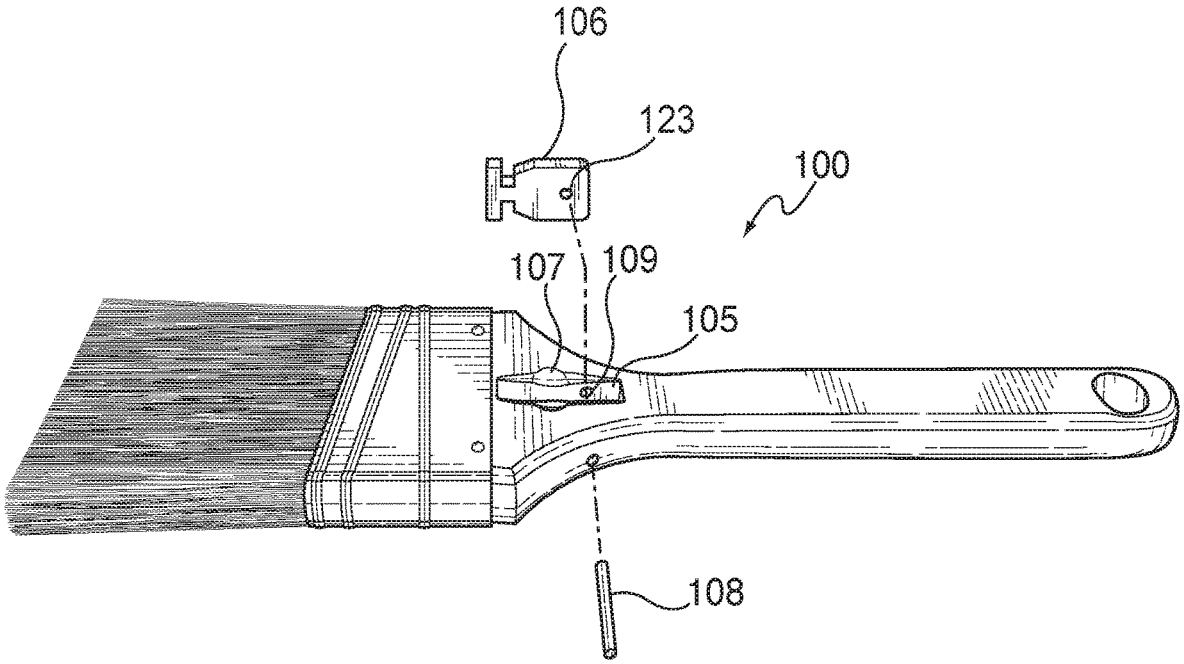
FIG. 4 is a diagram showing the first embodiment of the brush having an integral hanger in in disassembled form.

As shown in FIG. 2B, hanger 106 includes a head portion 120 that forms two slots 121, 122 and also has an aperture 123. Hanger 106 may include ridges at each top corner 124 in order to assist in opening and closing hanger 106. As seen in FIG. 4, pin 108 fits through aperture 123 to hold hanger 106 within channel 105. As discussed above, hanger 106 may alternatively be held in channel 104 via bumps formed on hanger 106 that fit into concave receptacles within channel 105. Slots 121 and 122 allow the hanger 106 to swivel to either side of brush 100 for use in hanging brush 100 on an appropriate object such as paint container 110 shown in FIG. 3 without having to look at container 110 when hanging brush 100 thereon, saving time and improving safety.

Figure 5:
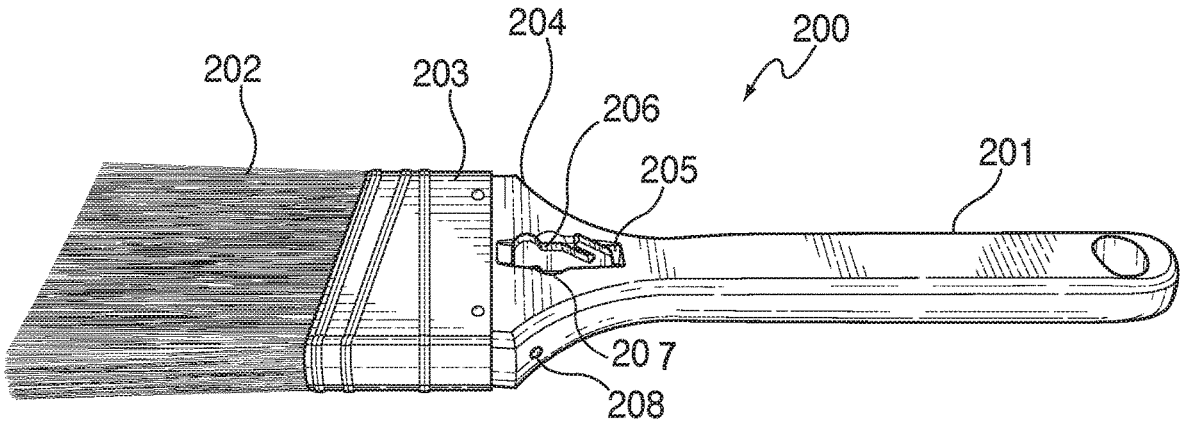
FIG. 5 is a diagram showing a second embodiment of the brush having an integral hanger in a closed position according to the present disclosure.

In the first embodiment shown in FIGS. 1 to 4, hanger 106 rotates on a pin 108 that is at a distal end of channel 105 opposite from the bristles 102 and ferrule 103. In a second embodiment shown in FIGS. 5 to 7, a hanger 206 rotates on a pin 208 that is at a proximal end of channel 205 adjacent to the bristles 202 and ferrule 203. In particular, a paint brush 200 conventionally includes a handle having a gripping portion 201 and a neck portion 204, a ferrule 203, and bristles 202. Ferrule 203 conventionally holds bristles 202 in place and is mated to the neck portion 204. Paint brush 200 also includes a channel 205 formed vertically (parallel to the position of the bristles 202) in the neck portion 204 that passes completely through neck portion 204. A hanger 206 is mounted in channel 205 via a pin 208 that is positioned within channel 205 in a position proximal and adjacent to the bristles 202 and ferrule 203. Alternately, hanger 206 may be mounted via bumps thereon and corresponding concave receptacles within channel 205, as in the first embodiment.

Figure 6:
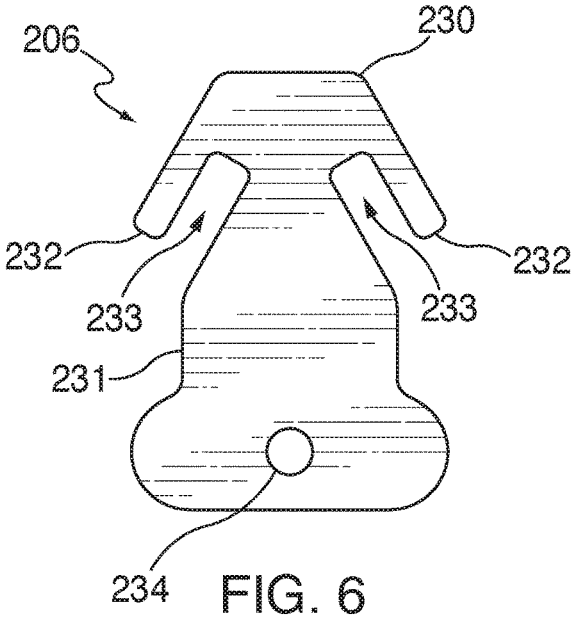
FIG. 6 is a diagram showing the integral hanger of the second embodiment of the brush according to the present disclosure.
Figure 7:
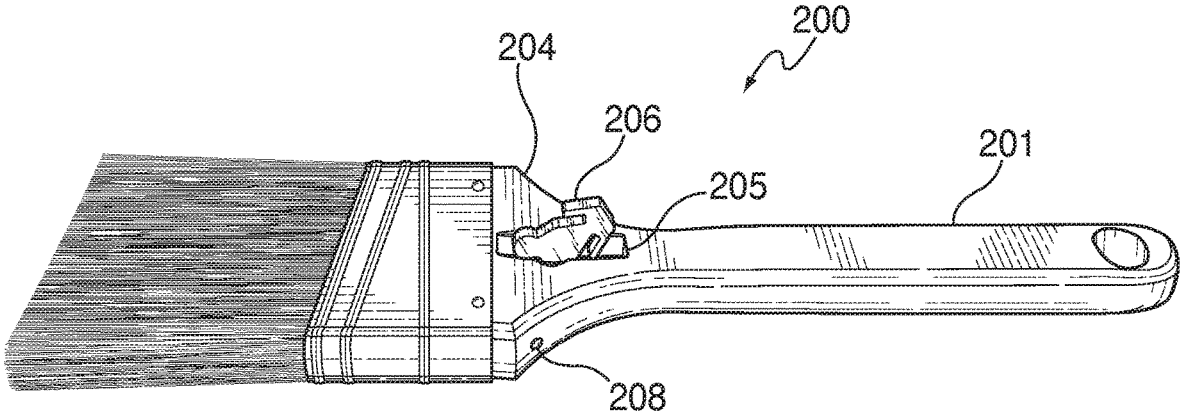
FIG. 7 is a diagram showing a second embodiment of the brush having an integral hanger in an open position according to the present disclosure.

Referring now to FIG. 6, hanger 206 preferably includes a body portion 231, an aperture 234 within body portion 230, a head portion 230, and two extension arms 232 extending from the head portion 230. Each extension arm 232 forms a respective slot 233. As can be seen from FIGS. 5 and 7, hanger 206 rotates between a closed position (FIG. 5) and an open position (FIG. 7). The slots 233 of hanger 206 are adapted to fit over the lip of a paint container, allowing paint brush 200 to hang on a paint container from either side of brush 200, depending on how hanger 206 is opened (i.e., to which side it is opened). The gripping portion 201, hanger 206, and pin 207 may be formed from any appropriate material, including wood, plastic, metal, composites, etc., including combinations thereof. In an alternative embodiment, a portion of ferrule 203 may be cut away and channel 205 may be moved towards bristles 202 or channel 205 may be moved away from ferrule 203 towards gripping portion 201 (in a resting position which allows brush 200 to hang with the bristles 202 within the paint within a container, preventing paint on bristles 202 from drying out during any rest period).

Figure 8:
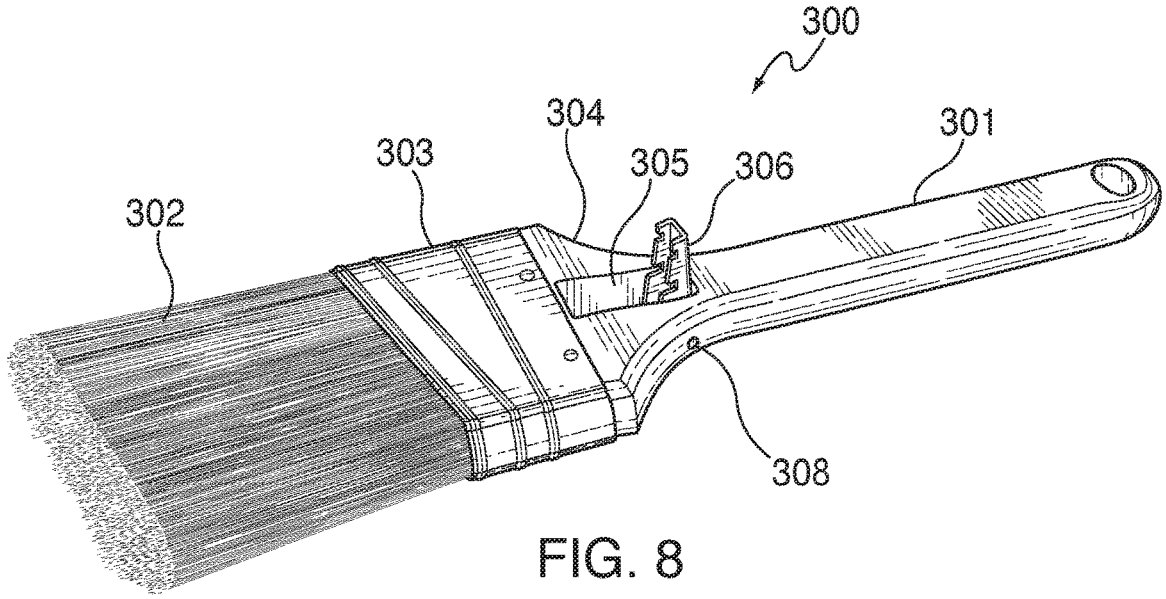
FIG. 8 is a diagram showing a third embodiment of the brush having an integral hanger in an open position according to the present disclosure.
Figure 9:
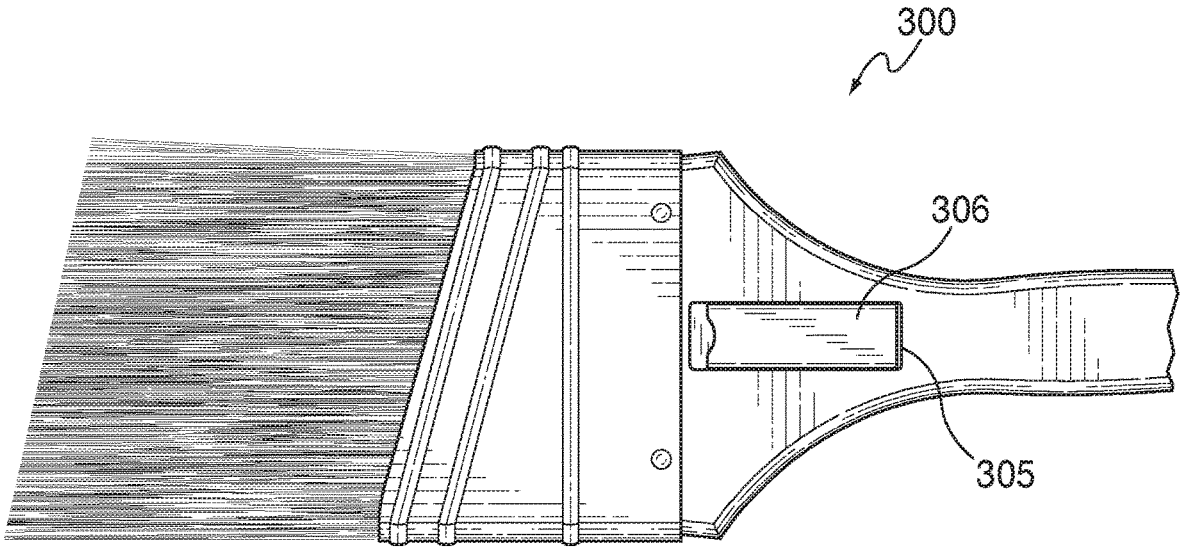
FIG. 9 is a diagram showing the third embodiment of the brush having an integral hanger hanging in a paint container according to the present disclosure.
Figure 10:
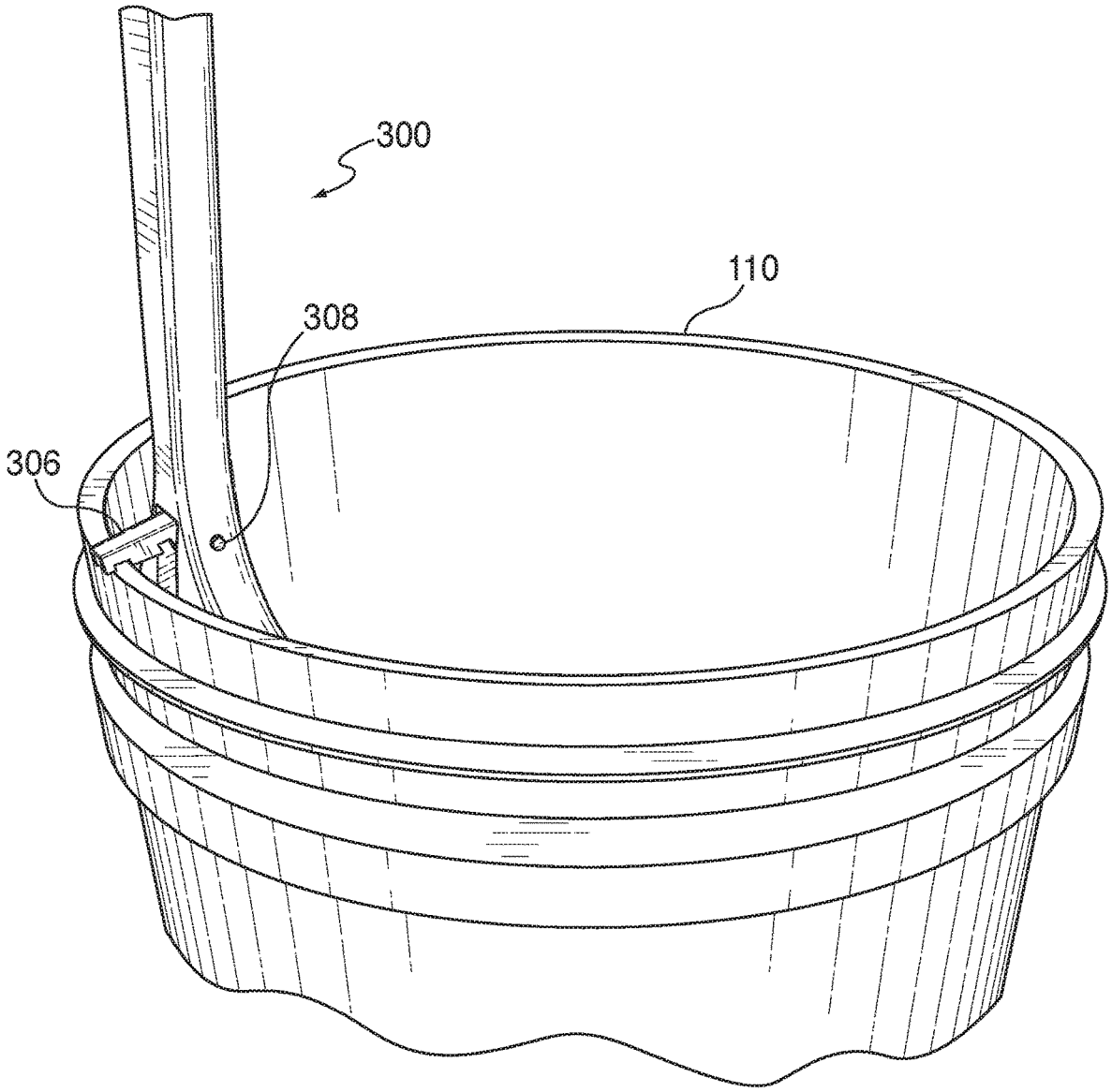
FIG. 10 is a diagram showing a rear view of the third embodiment of the brush according to the present disclosure.

In a third embodiment shown in FIGS. 8 to 10, a paint brush 300 conventionally includes a handle having a gripping portion 301 and a neck portion 304, a ferrule 303, and bristles 302. Ferrule 303 conventionally holds bristles 302 in place and is mated to the neck portion 304. Paint brush 300 also includes a channel 305 formed vertically (parallel to the position of the bristles 302) in the neck portion 304 that passes completely through neck portion 304. A spring-loaded two-part hanger 306 is mounted in channel 305 via a pin 308. Hanger 306 includes a spring mechanism that operates similar to a self-closing door hinge. In FIG. 9, the back side 309 of hanger 306 is shown in a closed position, while the front side (not seen) is in an open position (as seen in FIGS. 8 and 10). Hanger 306 may be opened by pressing on either side (and the element on that side will spring open) and can be closed by pressing in the side until it is secured. This spring-loaded mechanism provides a convenient way to open and close hanger 306. The handle 301, 304 and pin 308 may be formed from any appropriate material, including wood, plastic, metal, composites, etc., including combinations thereof. Hanger 306 is formed from a metal, plastic or composite, with an appropriate spring material included. In an alternative embodiment, a portion of ferrule 303 may be cut away and channel 305 may be moved towards bristles 302 or channel 305 may be moved away from ferrule 303 towards gripping portion 301 as discussed above with respect to the first and second embodiments.

Figure 11A:
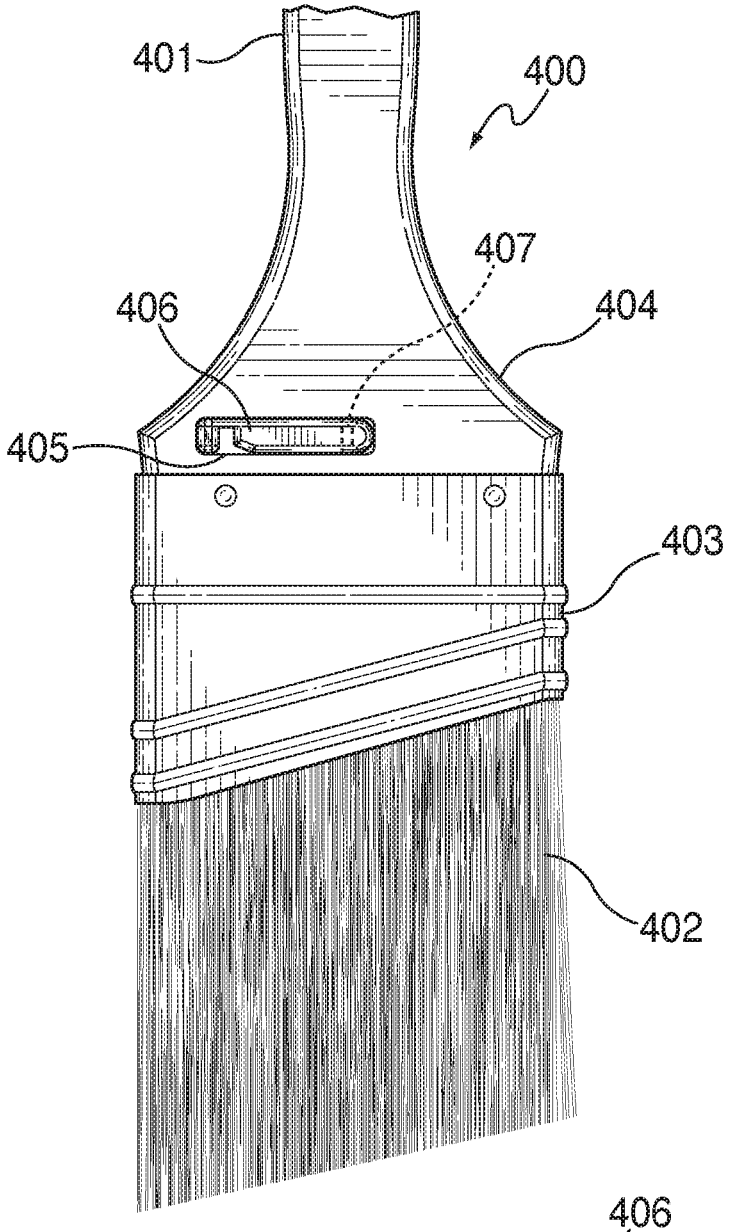
FIG. 11A is a diagram showing a fourth embodiment of the brush having an integral hanger in a closed position according to the present disclosure.
Figure 11B:
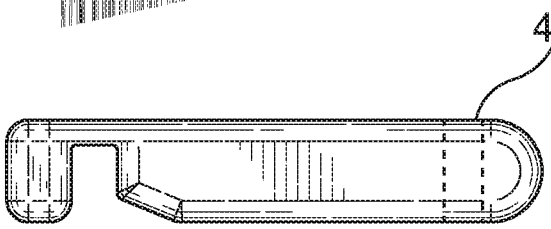
FIG. 11B is a side view of the integral hanger of the fourth embodiment.
Figure 11C:
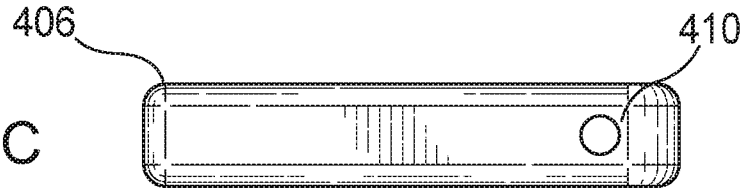
FIG. 11C is a top view of the integral hanger of the fourth embodiment.

In a fourth embodiment shown in FIGS. 11A, 11B, 11C, a paint brush 400 conventionally includes a handle having a gripping portion 401 and a neck portion 404, a ferrule 403, and bristles 402. Ferrule 403 conventionally holds bristles 402 in place and is mated to the neck portion 404. Paint brush 400 also includes a channel 405 formed horizontally (perpendicular to the position of the bristles 102) in the neck portion 404 that passes completely through neck portion 404. Here, channel 405 is formed perpendicular to the center axis of gripping portion 401. A hanger 406 is mounted within channel 405, preferably via a pin 407 that passes through an aperture 410 (FIG. 11C). Hanger 406 forms a slot, shown in side view thereof in FIG. 11B, that fits over the lip of a paint container when hanger 406 is positioned outside of channel 405. FIG. 11C is a top view of hanger 406 showing aperture 410 at one end thereof. In other embodiments, hanger 406 may be adapted to be press-fit into channel 405 via bumps on hanger 106 or an interior wall of channel 405 and corresponding concave receptacles in channel 405 or a surface of hanger 106 to allow hanger 406 to rotate into and out of channel 405 via an axis coexistent with the aperture 410 shown in FIG. 11C.

Figure 12:
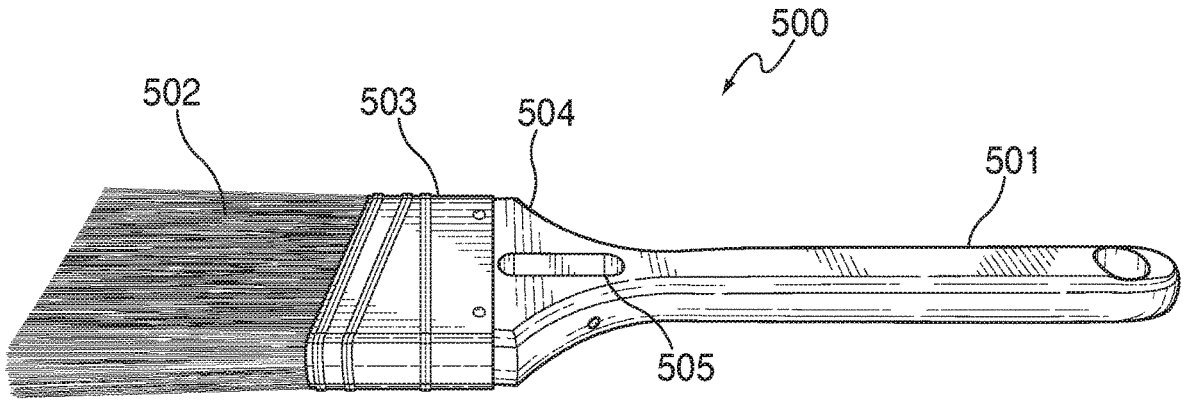
FIG. 12 is a diagram showing a first portion of a fifth embodiment of the brush having an integral hanger according to the present disclosure.
Figure 13A:
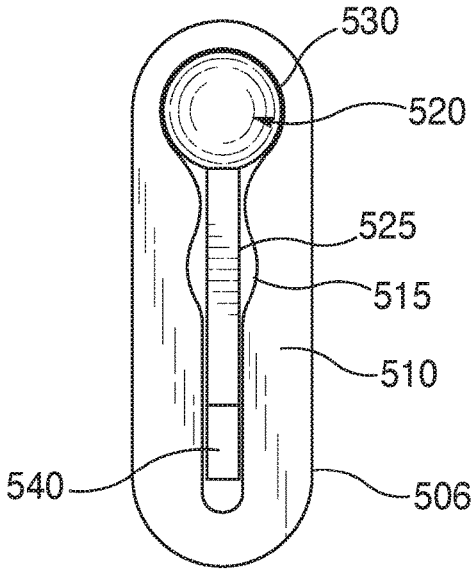
FIG. 13A is a diagram showing a second portion of a fifth embodiment of the brush having an integral hanger in a closed position according to the present disclosure.
Figure 13B:
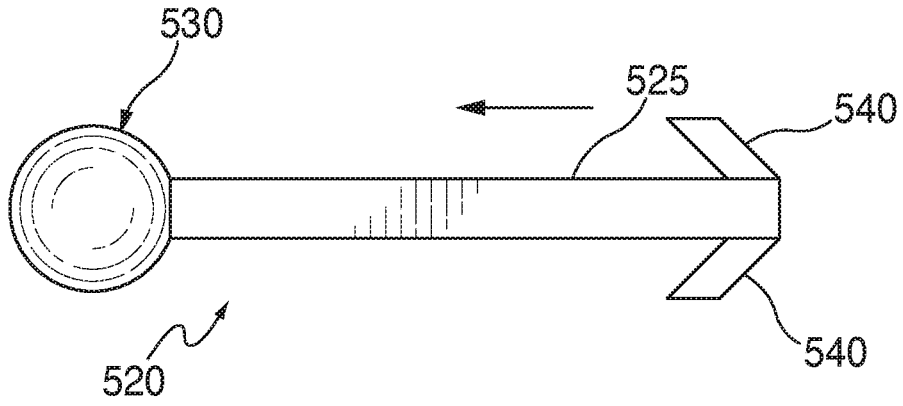
FIG. 13B is a diagram showing only the hanger of the second portion of the fifth embodiment according to the present disclosure.
Figure 14:
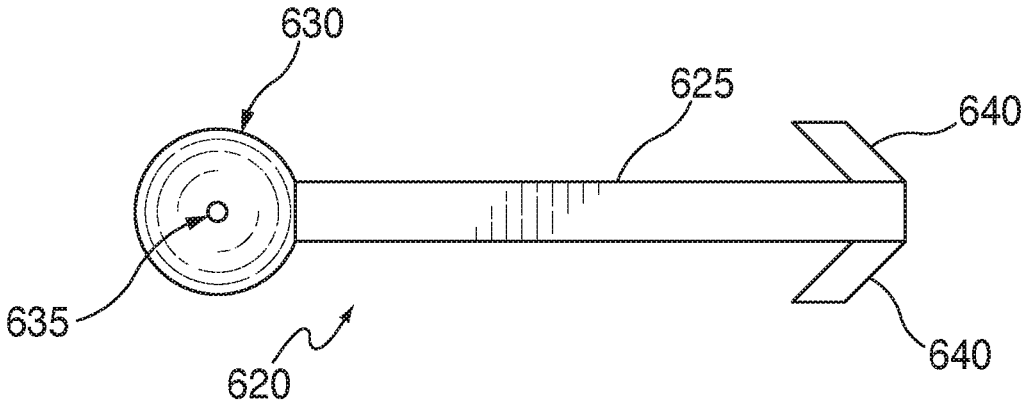
FIG. 14 is a diagram showing an alternative version of the hanger of the second portion of the fifth embodiment according to the present disclosure.

In a fifth embodiment shown in FIGS. 12, 13A and 13B, a paint brush 500 conventionally includes a handle having a gripping portion 501 and a neck portion 504, a ferrule 503, and bristles 502. Ferrule 503 conventionally holds bristles 502 in place and is mated to the neck portion 504. Paint brush 500 also includes a channel 505 formed vertically (parallel to the position of the bristles 502) in the neck portion 504 that passes completely through neck portion 504. Channel 505 is preferably oval-shaped, but may be rectangular, square, or some other convenient shape. Channel 505 can be beveled to accept and hold firm a similarly shaped press-fit type insert such as insert 506 shown in FIG. 13A (which may include bump nodes on a wall of insert 506). Channel 505 may be unbeveled in other embodiments when insert 506 is permanently affixed to paint brush 500 in an appropriate manner, e.g. via an adhesive. Insert 506 preferably includes a frame portion 510 having an outer periphery matching the shape of channel 505 and a hinged hanger 520. Frame portion 510 preferably includes an open interior portion 515 adapted to allow a user to more easily press the hinged hanger open using a finger. Hinged hanger 520 is preferably rotatable between a closed position (completely within the body of the insert 506) and two open positions (i.e., rotated out of one or the other sides of paint brush 500 when insert 506 is installed into channel 505). Hanger 520 itself provides a resting spot to hang the paint brush 500 on the lip of a paint container via barbs 540. Hanger 520 preferably includes a spherical head portion 530 at a first end and an arm portion 525 that extends to a second end having two barbs 540, as specifically shown in FIG. 13B. In some cases it may be possible to provide only a single barb 540 on one side of arm portion 525. In this situation, paint brush 500 can only be hung from the side in which the single barb 540 extends outward. The spherical head portion 530 is adapted to be held within the inner periphery of frame 510 via a press-fit type of coupling. Head portion 530 may have other shapes and insert 506 may then be adapted to receive and hold such shape. This provides a user with the ability snap hanger 520 in and out of frame portion 510 and makes it easy to clean any accumulated dried paint out the interior of frame portion 510. In an alternative embodiment, shown in FIG. 14, an alternative hanger 620 may include an aperture 635 in spherical head 630 and an associated arm portion 625, and may be hinged to frame 510 via a pin inserted through aperture 635. Hanger 620 also includes barbs 640 (or a single barb as discussed above) at an end of arm portion 625 opposite from spherical head 630. In operation, a user need only rotate the spherical head portion 530 or press down on a central part of arm portion 525 in order to open or close hanger 520. This allows a user to roll hanger 510 open using only a single finger while maintaining grip on the brush 500. In another alternative embodiment, the hanger may consist of a flap formed from the same material as the frame, e.g., via a crease when the frame 510 and hanger are formed from a single piece of plastic material. Insert 506 is preferably press-fit into channel 505 so that it can be field-replaceable if, for example, the internal portion thereof becomes fouled with dried paint or the hinged portion becomes damaged. In other embodiments, insert 506 may be permanently affixed to the paint brush handle 501, 504 by an appropriate adhesive. In a preferred embodiment, insert 506 and hanger 520 may be formed from a material that is paint-resistant, e.g., silicone. Insert 506 may be configured to accept different sized hanger elements 520, each appropriate to a particular style paint container (e.g., 1 gallon, 2 gallon, 5 gallon etc.). In another alternative embodiment, the frame portion 510 may be omitted and channel 505 may be configured to directly accept hanger 520 via a press-fit connection, e.g., with concave receptacles provided within channel 505 to receive and hold the spherical portion head portion 530 or vice versa.

Figure 15A:
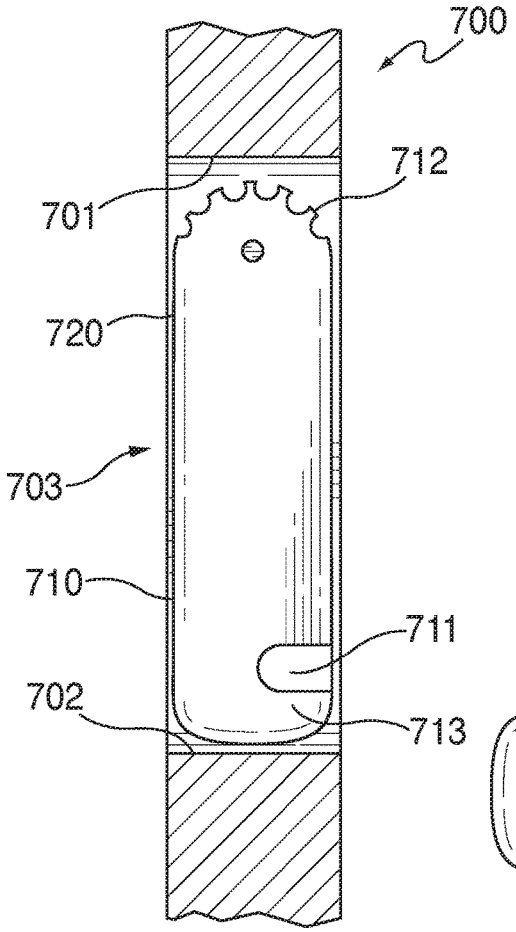
FIG. 15A is a partial side view of a sixth embodiment according to the present disclosure showing the hanger in a closed position.
Figure 15B:
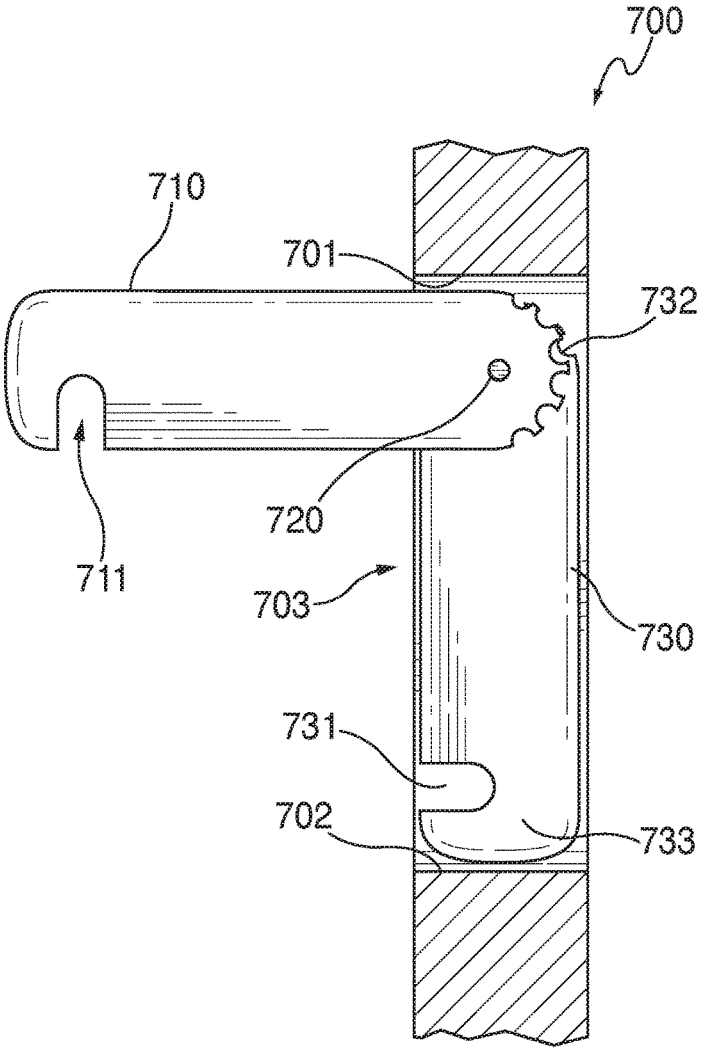
FIG. 15B is a partial side view of the sixth embodiment according to the present disclosure showing the hanger in an open position.

Referring now to FIGS. 15A and 15B, a sixth embodiment is shown. Here, a cross-sectional view of a brush 700 is shown. A channel 703 is formed vertically (parallel to the position of the bristles) through the body of brush 700 as in prior embodiments. The upper and lower peripheries of channel 703 are shown by lines 701, 702, respectively. Two hangers 710, 730 are mounted within channel 703 via a pin 720 inserted through an aperture in each hanger 710, 730, as shown in FIGS. 15A and 15B. In some cases, only one of the two hangers 710, 730 may be used. In an alternative embodiment, a single hanger, such as hanger 1020 shown in FIG. 21, may be substituted for hangers 710, 730. Hanger 710 includes a head portion 713 that has a slot 711 for mating with the lip of a paint container and a notched tail portion 712. Likewise, hanger 730 includes a head portion 733 that has a slot 731 for mating with the lip of a paint container and a notched tail portion 732. Hanger 1020 has slots 1032 and 1034 on each side of head portion 1036. When a user pushes downward on the notched tail portion 712 from a first side of brush 700, hanger 710 will pivot outward on a second side, as shown in FIG. 15B, to allow a user to hang brush 700 over the lip of a paint container by inserting the lip into slot 711 on the second side of brush 700. Similarly, when a user pushes downward on the notched tail portion 732 on the second side of brush 700, hanger 730 will pivot outward to allow a user to hang brush 700 over the lip of a paint container by inserting the lip into slot 731 on the first side of brush 700. This allows a user to hang brush 700 on a paint container on either side of brush 700 by selectively opening one of the two hangers. This type of hanger configuration allows a longer hanger element, ensuring that the brush 700 will remain on the lip of the paint container. This embodiment allows brush 700 to be hung from either side, using hanger 710 on one side and hanger 730 on other side. In an alternative embodiment, one of the two hangers 710, 730 may be omitted but this will only allow brush 700 to be hung from one side of brush 700.

Figure 16A:
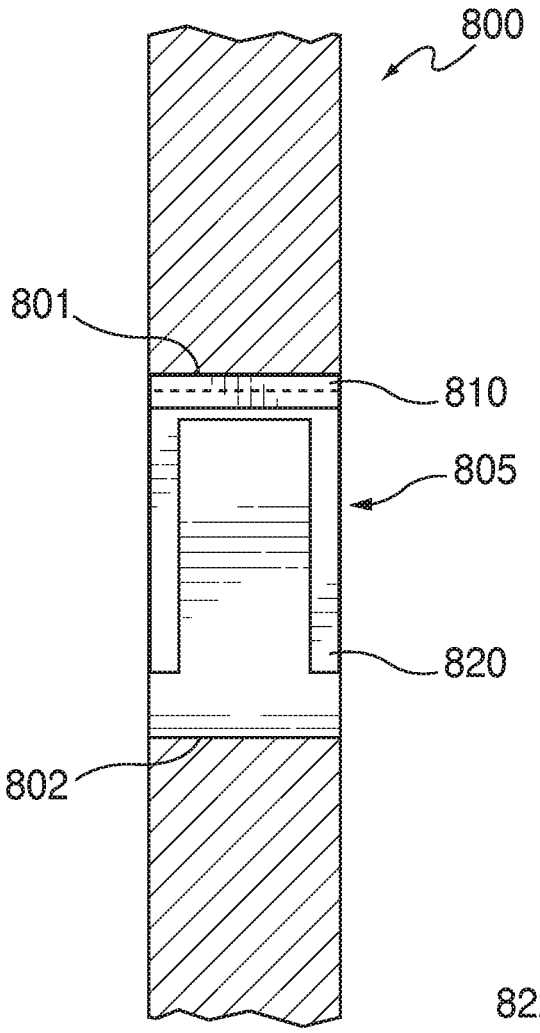
FIG. 16A is a partial side view of a seventh embodiment according to the present disclosure showing the hanger in a closed position.
Figure 16B:
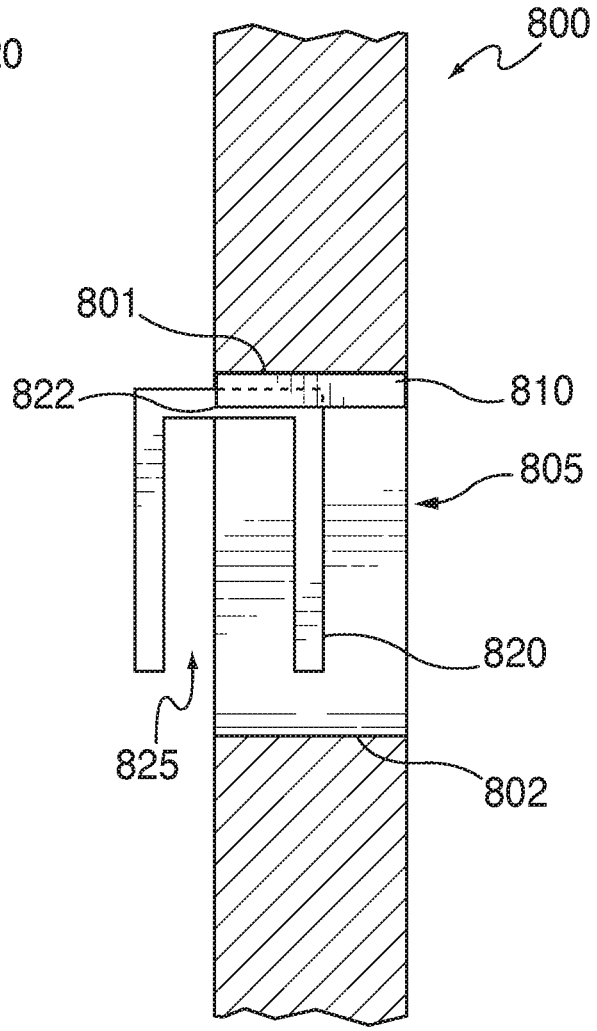
FIG. 16B is a partial side view of the seventh embodiment according to the present disclosure showing the hanger in an open position.
Figure 16C:
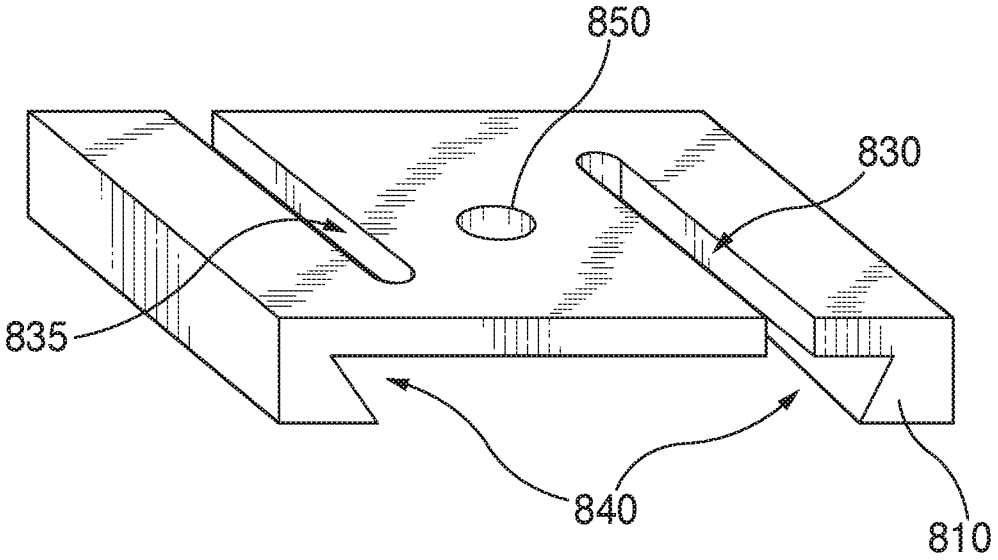
FIG. 16C is perspective view of a rail assembly for use in the seventh embodiment.
Figure 16D:
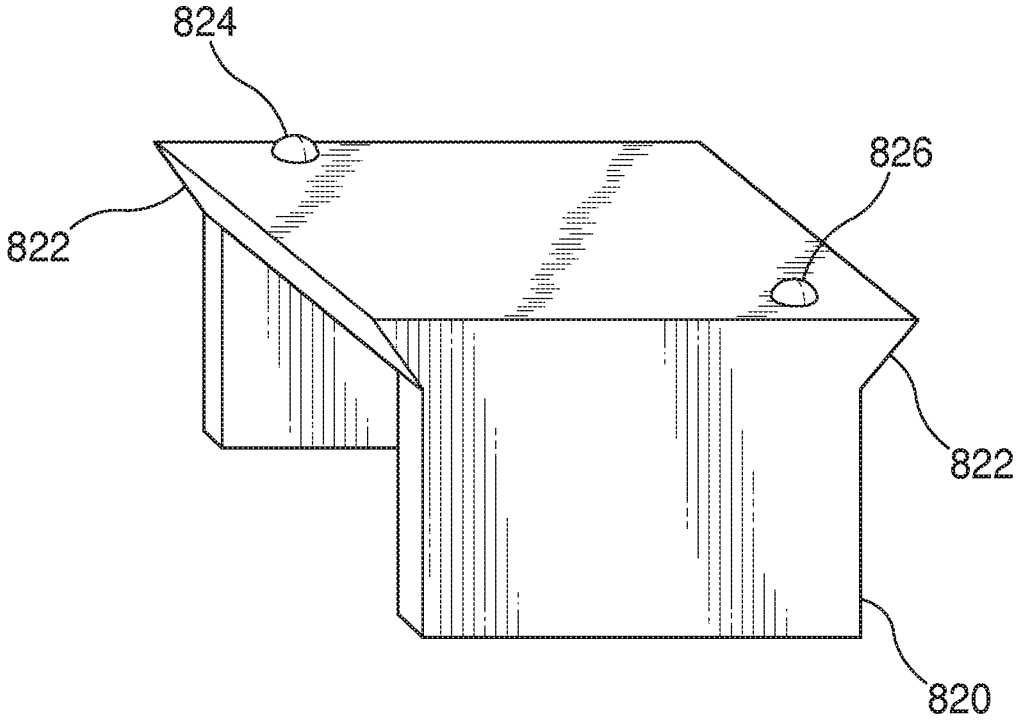
FIG. 16D is a perspective view of a hanger for use in the seventh embodiment.

Referring now to FIGS. 16A, 16B, 16C, and 16D, a seventh embodiment is shown. In this embodiment, a hanger assembly includes an inverted u-shaped member 820 and a rail 810, with the inverted u-shaped member 820 mounted on rail 810 within a channel 805 formed vertically (parallel to the position of the bristles) in brush 800. The upper and lower peripheries of channel 805 are shown by lines 801, 802, respectively. The rail 810 is affixed to an upper part of channel 805 at line 801 via, for example, a screw mounted in aperture 850 or an appropriate adhesive. Rail 810 includes a slot 840 that mates with the top portion of inverted u-shaped member 820, with notched portions 822 of the top portion of inverted u-shaped member 820 fitting into slot 840. The top surface of the top portion of inverted u-shaped member 820 includes two bump stops 824, 826. The bump stops 824, 826 fit into respective channels 835, 830 in rail 810 and prevent inverted u-shaped member 820 from sliding completely out of each side of rail 810 when the inverted u-shaped member 820 is moved between a closed position completely within channel 805 (FIG. 16A) to an open position with part of the inverted u-shaped member 820 outside of channel 805 (FIG. 16B). The inverted u-shaped member 820 may be moved to either side of brush 800 in the open position. In this open position. the portion of inverted u-shaped member 820 forms a slot 825 for use in hanging brush 800 on the lip of a paint container, and the bump stops 824, 826 prevent the inverted u-shaped member 820 from sliding out of the slot 840 in rail 810.

Figure 17:
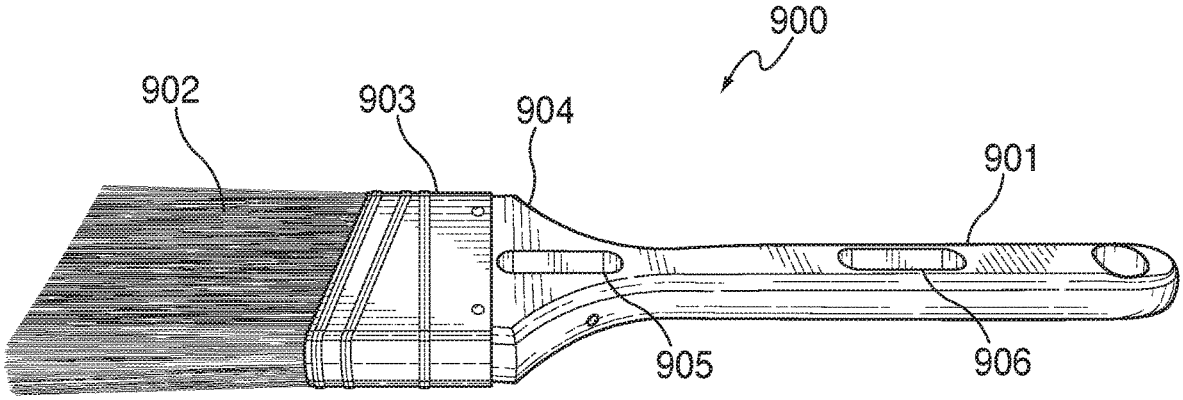
FIG. 17 is a diagram showing one further adaptation of the various embodiments of the present disclosure.
Figure 18:
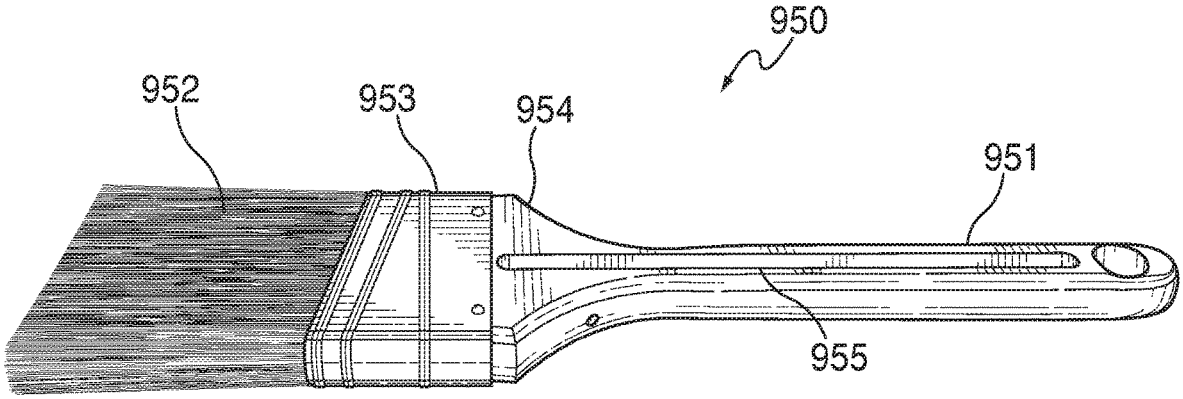
FIG. 18 is a diagram showing another further adaptation of the various embodiments of the present disclosure.

When the hanger of the present disclosure is positioned in a channel that is close (proximal) to the ferrule of the paint brush, the brush will typically hang on the lip of the paint container with the bristles above the surface of the paint within the paint container. In some situations, for example the rest mode position discussed above, it may be desired that the bristles be positioned within the paint to prevent the paint from drying on the bristles. This may occur when there is a need for a lunch break, coffee break, etc. To accommodate this requirement, the hanger needs to be located further up on the handle of the paintbrush. In the embodiment shown in FIG. 17, a second channel may be added to the brush to allow either a second hanger to be added or to allow the hanger to be moved between two positions, with a first position allowing the paint brush to hang with the bristles out of the paint (working position) and a second position allowing the paint brush to hang with the bristles in the paint (rest mode position). Referring now to FIG. 17, a paint brush 900 may include a handle having a gripping portion 901 and a neck portion 904, a ferrule 903, and bristles 902. Ferrule 903 conventionally holds bristles 902 in place and is mated to the neck portion 904. Paint brush 900 also includes a first channel 905 formed in the neck portion 904 that passes completely through neck portion 904 and a second channel 906 formed in the gripping portion 901 that passes completely through gripping portion 904. In this embodiment, a hanger insert, such as the hanger insert 506 shown in FIG. 13A, may be mounted in each of the first channel 905 and the second channel 906. This allows a user to selectively hang brush 900 with the bristles 902 out of the paint using the hanger insert mounted in channel 905 (i.e., the working position) or with the bristles 902 within the paint using the hanger insert mounted in channel 906 (i.e., the rest mode position). In other alternative embodiments, one or more additional channels may be provided to accommodate different size paint containers, etc. Alternatively, only one hanger insert may be provided and a user may move the hanger insert between channel 905 and channel 906, depending on whether the bristles 902 are to be positioned outside of or within the paint within the paint container, e.g., a one or two gallon pail. In an alternative embodiment, a brush may omit the first channel 905 and only include second channel 906, in the event that a brush is desired which can only be hung with the bristles 902 within the paint. Alternatively, as shown in FIG. 18, a brush 950 may be provided which includes a handle having a gripping portion 951 and a neck portion 954, a ferrule 953, bristles 952, and a channel 955 extending from close to the top portion of ferrule 953 to a distal point on gripping portion 951. In this embodiment, the hanger insert 506 shown in FIG. 13A may be adapted to be selectively mounted at a user-desired position anywhere along channel 955, e.g., by press-fit coupling within such channel.

Figure 19:
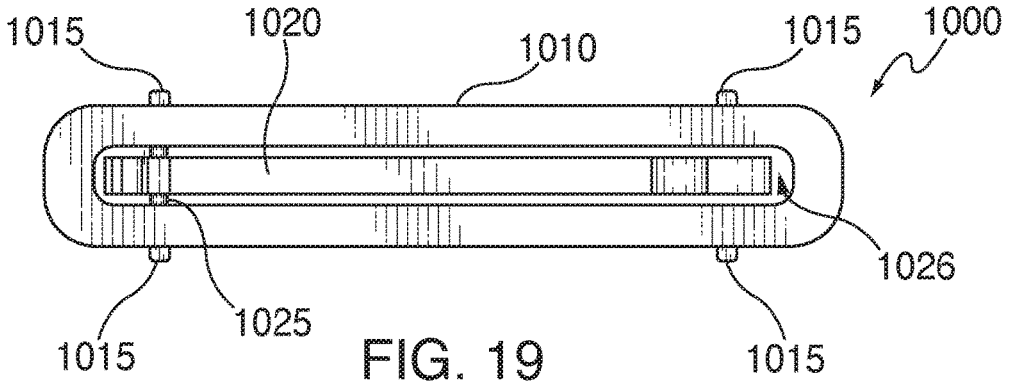
FIG. 19 is a diagram showing a top view of a hanger insert according to an eighth embodiment of the present disclosure.
Figure 20:
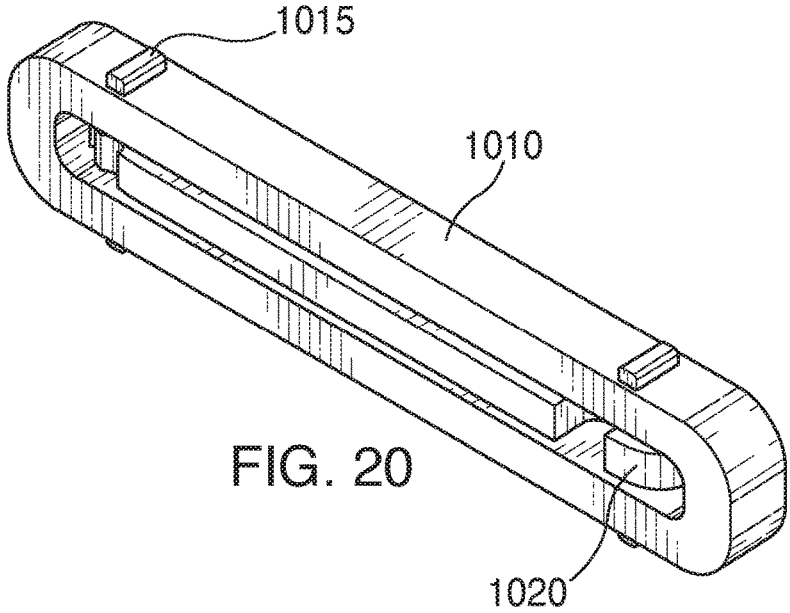
FIG. 20 is a diagram showing a top side perspective view of a hanger insert according to an eighth embodiment of the present disclosure.
Figure 21:
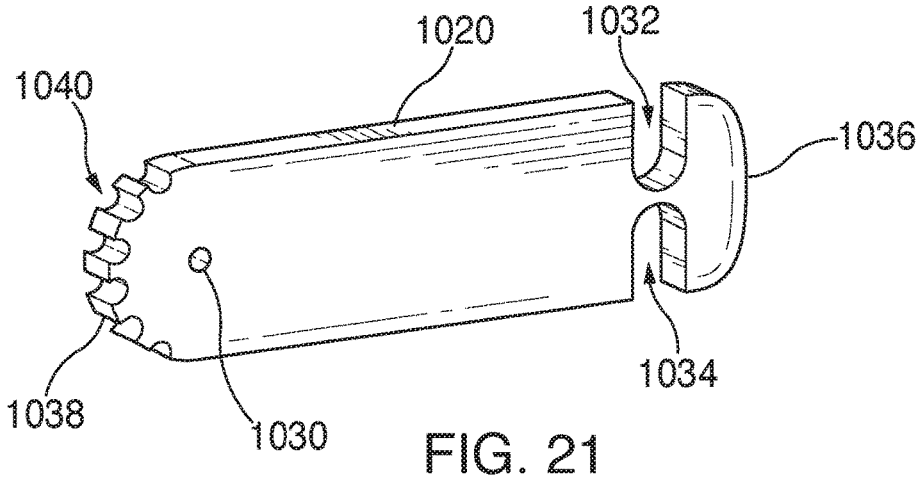
FIG. 21 is a diagram showing a front side perspective view of a single hanger according to an eighth embodiment of the present disclosure.

Referring now to FIGS. 19, 20, and 21, in an eighth embodiment, an insert 1000 having a single hanger 1020 is adapted to fit into an aperture in a handle of a paintbrush, such as the aperture 505 in paintbrush 500 shown in FIG. 12. Insert 1000 is held in place in aperture 505 in a similar manner as insert 506 in FIG. 13A, e.g., in a press-fit manner using bump nodes 1015 or by an appropriate adhesive. Insert 1000 includes a frame portion 1010 having an outer periphery matching the shape of channel 505 and a hinged hanger 1020. Hinged hanger 1020 is preferably mounted in frame portion 1010 using a pin 1025 passing through aperture 1030 in hinged hanger 1020. Hinged hanger 1020 is rotatable between a closed position (completely within the interior 1026 of the insert 1000) and two open positions (i.e., rotated out of one or the other sides of paint brush 500 when insert 1000 is installed into channel 505). Hanger 1020 preferably includes notches 1040 at an outer end edge 1038 thereof that can be used to help slide hanger 1020 from the closed position to one of the two open positions. When in one of the two open positions, hanger 1020 provides a resting spot to hang the paint brush 500 on the lip of a paint container via one or the other of slots 1032, 1034 at an end 1036 of hanger 1020.

Figure 22:
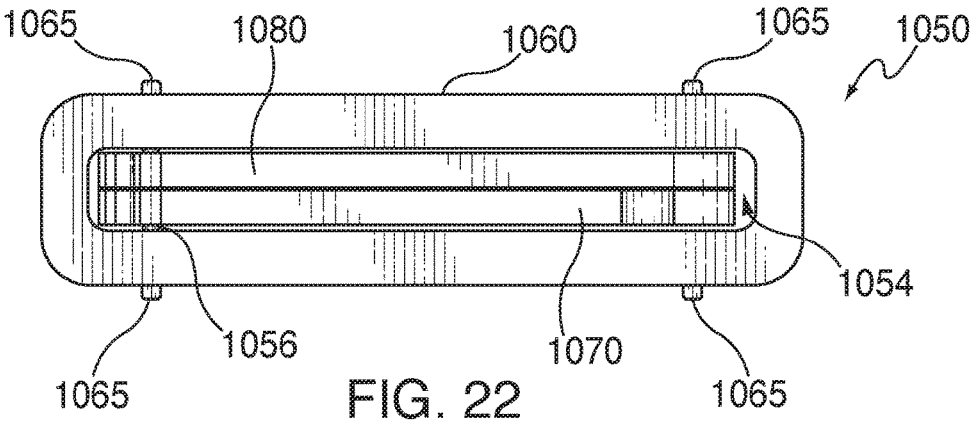
FIG. 22 is a diagram showing a top view of a hanger insert according to a ninth embodiment of the present disclosure.
Figure 23:
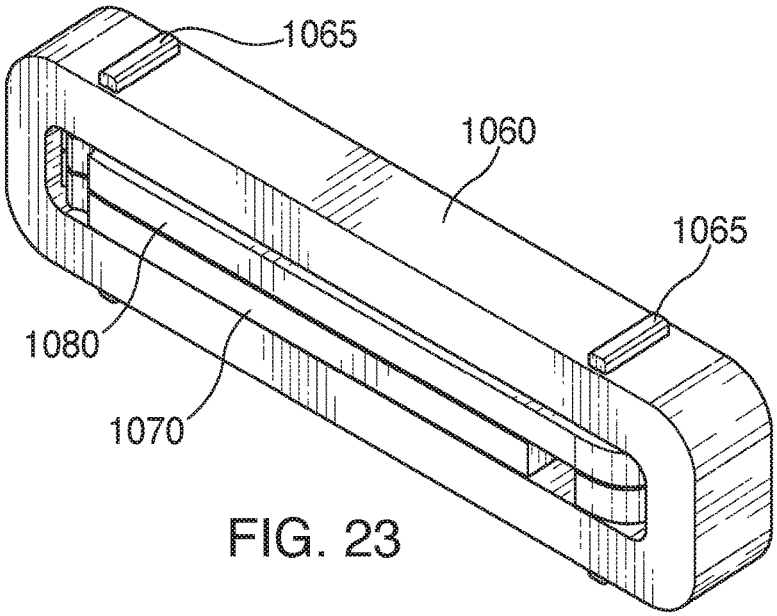
FIG. 23 is a diagram showing a top side perspective view of a hanger insert according to a ninth embodiment of the present disclosure.
Figure 24:
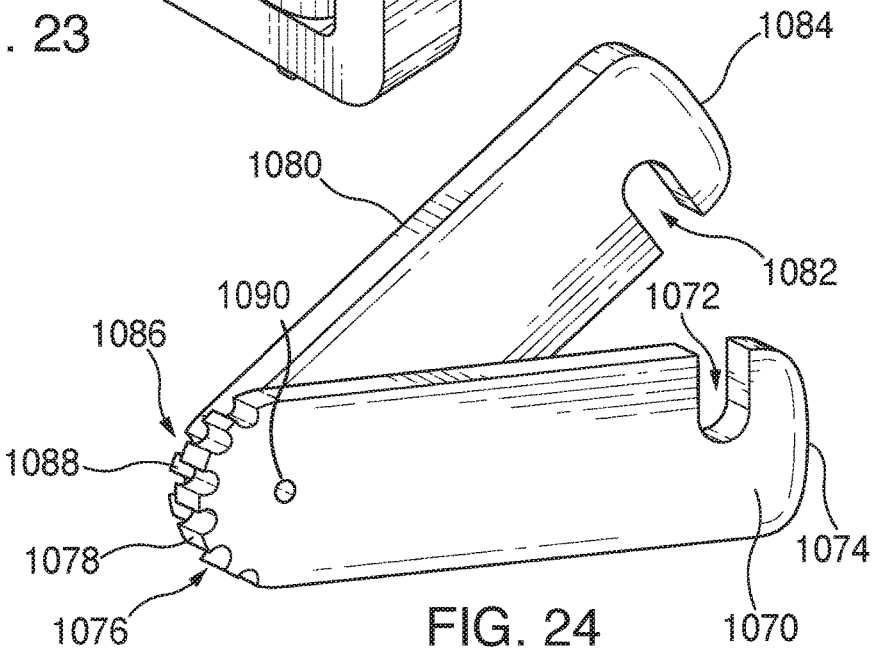
FIG. 24 is a diagram showing a front side perspective view of a two paired hangers according to a ninth embodiment of the present disclosure.

Referring now to FIGS. 22, 23, and 24, in an ninth embodiment, an insert 1050 having two separate hangers 1070, 1080 is adapted to fit into an aperture in a handle of a paintbrush, such as the aperture 505 in paintbrush 500 shown in FIG. 12. Insert 1050 is held in place in aperture 505 in a similar manner as insert 506 in FIG. 13A, e.g., in a press-fit manner using bump nodes 1065 or by an appropriate adhesive. Insert 1050 includes a frame portion 1060 having an outer periphery matching the shape of channel 505 and two hinged hangers 1070, 1080. Each hinged hanger 1070, 1080 is preferably mounted in frame portion 1060 using a pin 1056 passing through an aperture in each hinged hanger 1070, 1080 (e.g., aperture 1090 on hanger 1070). Each hinged hanger 1070, 1080 is rotatable between a closed position (completely within the interior 1054 of the insert 1050) and an open position with the respective slot 1072, 1082 facing downward to facilitate mating with the lip of a paint container, etc., used to hang the paintbrush. Each hanger 1070, 1080 preferably includes notches 1076, 1086 around an outer end edge 1078, 1088 thereof that each can be used to slide the associated hanger 1070, 1080 from the closed position to the respective open position.

The various embodiments disclosed herein provide a tool that is much easier and safer to handle, especially in situations where the user is only able to grip the tool with one hand, and easier to clean and maintain. By placing the hanger in a channel that passes completely through the body of the tool, a user is easily able to open the hanger while maintaining control of the tool and position the tool on a lip of a container (or other hanging point) without having to look down. This provides both time savings and additional safety to the user since there is no need to look down every time the tool is positioned in the container and since the user will always have a free hand, e.g., to maintain grip on a ladder. Furthermore, a brush employing one of the embodiments disclosed herein will last longer, since the ability to keep the brush in an upright position hanging on the lip of a paint container will ensure that paint does not collect under the ferrule and making the brush easier to clean after each use.

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. A tool having an integral hanger, comprising:

a tool having a handle including a gripping portion and a neck portion, and a channel within the handle which passes completely through the handle; and an insert adapted to fit within the channel, the insert including a frame portion and a hanger, the hanger having a head portion at a first end thereof and an arm portion extending from the head portion to a second end thereof, the arm portion having a first barb extending outward towards a first side of the handle at the second end thereof, the hanger hingedly mounted to the insert via the head portion, the hanger adapted to rotate between a position where the arm portion is completely within the channel to a first position on a first side of the handle with the end of the arm portion outside of the channel and to a second position on a second side of the handle with the end of the arm portion outside of the channel, the arm portion adapted to securely hold the tool on a lip of a container when the hanger is rotated to the first position.

2. The tool of claim 1, wherein the arm portion has a second barb extending outward towards the second side of the handle at the second end thereof and the arm portion is adapted to securely hold the tool on a lip of a container when the hanger is rotated to the first position or to the second position.

3. The tool of claim 1, wherein the channel is positioned at a point proximal to the neck portion and further comprising:

a second channel within the handle which passes completely through the handle, the second channel position at a point distal to the neck portion; and wherein the insert is adapted to selectively fit within the channel or the second channel.

4. The tool of claim 1, wherein the channel extends from a point proximal to the neck portion to a point distal to the neck portion and wherein the insert is adapted to fit within the channel selectively at any point between a proximal end thereof and a distal end thereof.

5. A tool having an integral hanger, comprising:

a tool having a handle including a gripping portion and a neck portion, and a channel within the handle which passes completely through the handle; and a hanger hingedly mounted at a first end thereof within the channel, the hanger having a tail portion at the first end thereof and a head portion at a second end thereof, the hanger adapted to rotate between a position completely within the channel to a first position on a first side of the handle outside of the channel and to a second position on a second side of the handle outside the channel, the head portion having a first slot to securely hold the tool on a lip of a container when the hanger is rotated to the first position and a second slot to securely hold the tool on a lip of a container when the hanger is rotated to the second position.

6. A tool having an integral hanger, comprising:

a tool having a handle including a gripping portion and a neck portion, and a channel within the handle which passes completely through the handle;

a first hanger hingedly mounted at a first end thereof within the channel, the first hanger having a tail portion at the first end thereof and a head portion at a second end thereof, the first hanger adapted to rotate between a position completely within the channel to a first position on a first side of the handle outside of the channel, the head portion having a slot to securely hold the tool on a lip of a container when the hanger is rotated to the first position; and a second hanger hingedly mounted at a first end thereof within the channel, the second hanger having a tail portion at the first end thereof and a head portion at a second end thereof, the second hanger adapted to rotate between a position completely within the channel to a second position on a second side of the handle outside of the channel, the head portion having a slot to securely hold the tool on a lip of a container when the hanger is rotated to the second position.

7. A tool having an integral hanger, comprising:

a tool having a handle including a gripping portion and a neck portion, and a channel within the handle which passes completely through the handle; and a hanger assembly mounted within the channel, the hanger assembly including a rail and an inverted u-shaped member coupled to the rail at an upper portion thereof, the inverted u-shaped member having two downward extending members mated to the upper portion forming the inverted u-shape, the inverted u-shaped member adapted to slide along the rail between a first position where each of the two downward extending members are completely within the channel, a second position with a first of the two downward extending members positioned completely outside a first side of the handle, and a third position with a second of the two downward extending members positioned completely outside a second side of the handle, the hanger assembly adapted to hold the tool to a lip of a container on the first side of the handle when the inverted u-shaped member is moved to the second position and to hold the tool to a lip of a container on the second side of the handle when the inverted u-shaped member is moved to the third position.

8. A tool having an integral hanger, comprising:

a tool having a handle including a gripping portion and a neck portion, and a channel within the handle which passes completely through the handle; and an insert adapted to fit within the channel, the insert including a frame portion and a hanger, the hanger hingedly mounted at a first end thereof within the frame portion, the hanger having a tail portion at the first end thereof and a head portion at a second end thereof, the hanger adapted to rotate between a position completely within an interior part of the frame portion to a first position on a first side of the handle outside of the frame portion and to a second position on a second side of the handle outside the frame portion, the head portion having a first slot to securely hold the tool on a lip of a container when the hanger is rotated to the first position and a second slot to securely hold the tool on a lip of a container when the hanger is rotated to the second position.

9. A tool having an integral hanger, comprising:

a tool having a handle including a gripping portion and a neck portion, and a channel within the handle which passes completely through the handle;

an insert adapted to fit within the channel, the insert including a frame portion and a first hanger, the first hanger hingedly mounted at a first end thereof within the frame portion, the first hanger having a tail portion at the first end thereof and a head portion at a second end thereof, the first hanger adapted to rotate between a position completely within an interior part of the frame portion to a position on a first side of the handle outside of the frame portion, the head portion of the first hanger having a slot to securely hold the tool on a lip of a container when the hanger is rotated to the first position; and wherein the insert further comprises a second hanger, the second hanger hingedly mounted at a first end thereof within the frame portion, the second hanger having a tail portion at the first end thereof and a head portion at a second end thereof, the second hanger adapted to rotate between a position completely within an interior part of the frame portion to a position on a second side of the handle outside of the frame portion, the head portion of the second hanger having a slot to securely hold the tool on a lip of a container when the second hanger is rotated to the second position.

10. A tool having an integral hanger, comprising:

a tool having a handle including a gripping portion and a neck portion, and a channel within the handle which passes completely through the handle; and a hanger hingedly mounted at a first end thereof within the channel, the hanger adapted to rotate between a position completely within the channel to a first position on a first side of the handle outside of the channel and to a second position on a second side of the handle outside of the channel, the hanger adapted to securely hold the tool on a lip of a container when the hanger is rotated to either the first position or the second position.

11. The tool of claim 10, wherein the channel is positioned within the neck portion and parallel to a center axis of the gripping portion, and wherein the hanger is hingedly mounted at a proximal end of the channel adjacent to the gripping portion.

12. The tool of claim 10, wherein the channel is positioned within the neck portion and parallel to a center axis of the gripping portion and wherein the hanger is hingedly mounted at a distal end of the channel opposite from the gripping portion.

13. The tool of claim 10, wherein the channel is positioned within the neck portion and perpendicular to a center axis of the gripping portion so that the hanger rotates horizontally with respect to an orientation of a center axis of the gripping portion.

* * * * *